US009685280B2

(12) United States Patent
Benson et al.

(10) Patent No.: US 9,685,280 B2
(45) Date of Patent: Jun. 20, 2017

(54) SWITCHGEAR OPERATING MECHANISM

(71) Applicant: S&C Electric Company, Chicago, IL (US)

(72) Inventors: Keith W. Benson, Chicago, IL (US); Henry W. Kowalyshen, Niles, IL (US); Xin Zhu, Chicago, IL (US)

(73) Assignee: S&C ELECTRIC COMPANY, Chicago, IL (US)

( * ) Notice: Subject to any disclaimer, the term of this patent is extended or adjusted under 35 U.S.C. 154(b) by 12 days.

(21) Appl. No.: 14/678,052

(22) Filed: Apr. 3, 2015

(65) Prior Publication Data

US 2015/0294809 A1 Oct. 15, 2015

Related U.S. Application Data

(60) Provisional application No. 61/978,520, filed on Apr. 11, 2014.

(51) Int. Cl.

| | |
|---|---|
| ***H01H 3/40*** | (2006.01) |
| ***H01H 3/46*** | (2006.01) |
| ***H01H 9/16*** | (2006.01) |
| ***H01H 3/30*** | (2006.01) |
| ***H01H 33/666*** | (2006.01) |

(Continued)

(52) U.S. Cl.

CPC ..... *H01H 3/46* (2013.01); *H01H 3/30* (2013.01); *H01H 9/16* (2013.01); *H01H 33/666* (2013.01); *H01H 3/40* (2013.01); *H01H 3/42* (2013.01); *H01H 2009/0292* (2013.01); *H01H 2033/6667* (2013.01)

(58) Field of Classification Search

CPC ..... H01H 3/3015; H01H 33/666; H01H 33/6661; H01H 33/6662; H01H 3/30; H01H 3/3042; H01H 3/605; H01H 9/0027; H01H 9/0038; H01H 9/24; H01H 33/022; H01H 3/3026; H01H 3/42; H01H 2033/6623

See application file for complete search history.

(56) References Cited

U.S. PATENT DOCUMENTS

| | | | |
|---|---|---|---|
| 3,898,407 | A | 8/1975 | Hodgson |
| 3,920,941 | A | 11/1975 | Hundstad |

(Continued)

OTHER PUBLICATIONS

The International Bureau of WIPO, International Preliminary Report on Patentability for International Application No. PCT/US2015/025030 mailed Oct. 20, 2016.

*Primary Examiner* — Truc Nguyen

(74) *Attorney, Agent, or Firm* — Lorenz & Kopf LLP

(57) ABSTRACT

An operating mechanism for a switchgear unit is disclosed. The operating unit includes an input drive shaft operable to rotate and counter-rotate. A trip linkage has a cam disk rotatably coupled to the input drive shaft and is coupled to a spring-drive mechanism for opening and closing the vacuum interrupter. An over-center linkage has a drive link rotatably coupled to the input drive shaft, and a follower link for opening and closing the isolating disconnect. Rotation of the input drive shaft through a first range drives the trip linkage for opening the vacuum interrupter and moves the drive link though an over-center position without opening the isolating disconnect. Rotation of the input drive shaft though a second range drives the over-center linkage for opening the isolating disconnect after the vacuum interrupter is opened.

20 Claims, 7 Drawing Sheets

(51) Int. Cl.
*H01H 3/42* (2006.01)
*H01H 9/02* (2006.01)

(56) References Cited

U.S. PATENT DOCUMENTS

| | | | | |
|---|---|---|---|---|
| 5,059,753 | A * | 10/1991 | Hamm | H01B 17/26 218/84 |
| 5,747,766 | A | 5/1998 | Waino et al. | |
| 5,912,604 | A | 6/1999 | Harvey et al. | |
| 6,140,894 | A | 10/2000 | Lane | |
| 6,156,989 | A | 12/2000 | Miller et al. | |
| 6,198,062 | B1 | 3/2001 | Mather et al. | |
| 6,362,444 | B1 | 3/2002 | Lee | |
| 6,444,939 | B1 | 9/2002 | Crookston et al. | |
| 6,674,039 | B1 | 1/2004 | Banghard et al. | |
| 7,041,929 | B2 | 5/2006 | Banghard et al. | |
| 7,075,027 | B1 | 7/2006 | Fogle et al. | |
| 7,215,228 | B2 | 5/2007 | Rhein | |
| 7,880,105 | B2 * | 2/2011 | Hashimoto | H01H 3/30 200/17 R |
| 2012/0241300 | A1 * | 9/2012 | Brasher | H01H 3/44 200/5 B |
| 2013/0026020 | A1 | 1/2013 | Yang | |
| 2014/0043119 | A1 | 2/2014 | Bullock et al. | |
| 2015/0311009 | A1 * | 10/2015 | Ding | H01H 3/3015 218/140 |

* cited by examiner

SWITCHGEAR OPERATING MECHANISM

CROSS-REFERENCE TO RELATED APPLICATION

This application claims the benefit of U.S. Provisional Application No. 61/978,520 filed on Apr. 11, 2014, the entire disclosure of which is incorporated herein by reference.

TECHNICAL FIELD

The present invention generally relates to circuit interrupters, and more particularly relates to a switchgear operating mechanism having a single drive shaft operating a circuit interrupter having a vacuum interrupter and isolating disconnect.

BACKGROUND

This section provides background information related to the present disclosure, which is not necessarily prior art.

Circuit interrupting devices may include two function which server to interrupt a power distribution system. One function operates to isolate a fault condition which may be reclosed manually or automatically after clearing the fault condition to restore the circuit. Such fault conditions in a power distribution system can occur for any number of reasons and are typically transient. Reclosing after the fault is cleared provides for quick service restoration. A second function operates to interrupt the power distribution circuit by disconnecting a portion of the power distribution system. This interrupt function is typically enabled for maintenance or repair and may be manual or automated in response to an interrupt request other that a fault condition.

To enable these two functions, a typical circuit-interrupting device may include a circuit interruption switch such as a vacuum interrupter and a circuit disconnect switch such as a isolating disconnect, which are separate, yet integral. Incorporating the sequenced operation of the switches presents a number of design challenges including: mechanical "early trip" of the vacuum interrupter, proper timing of the vacuum interrupter and isolating disconnect so that the isolating disconnect do not open or closed under normal load or fault conditions, possible vacuum interrupter malfunction (welding), potential operator error resulting in an incomplete reset of the circuit interrupting device, and unbalanced torque and energy required for opening or closing the circuit interrupting device.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
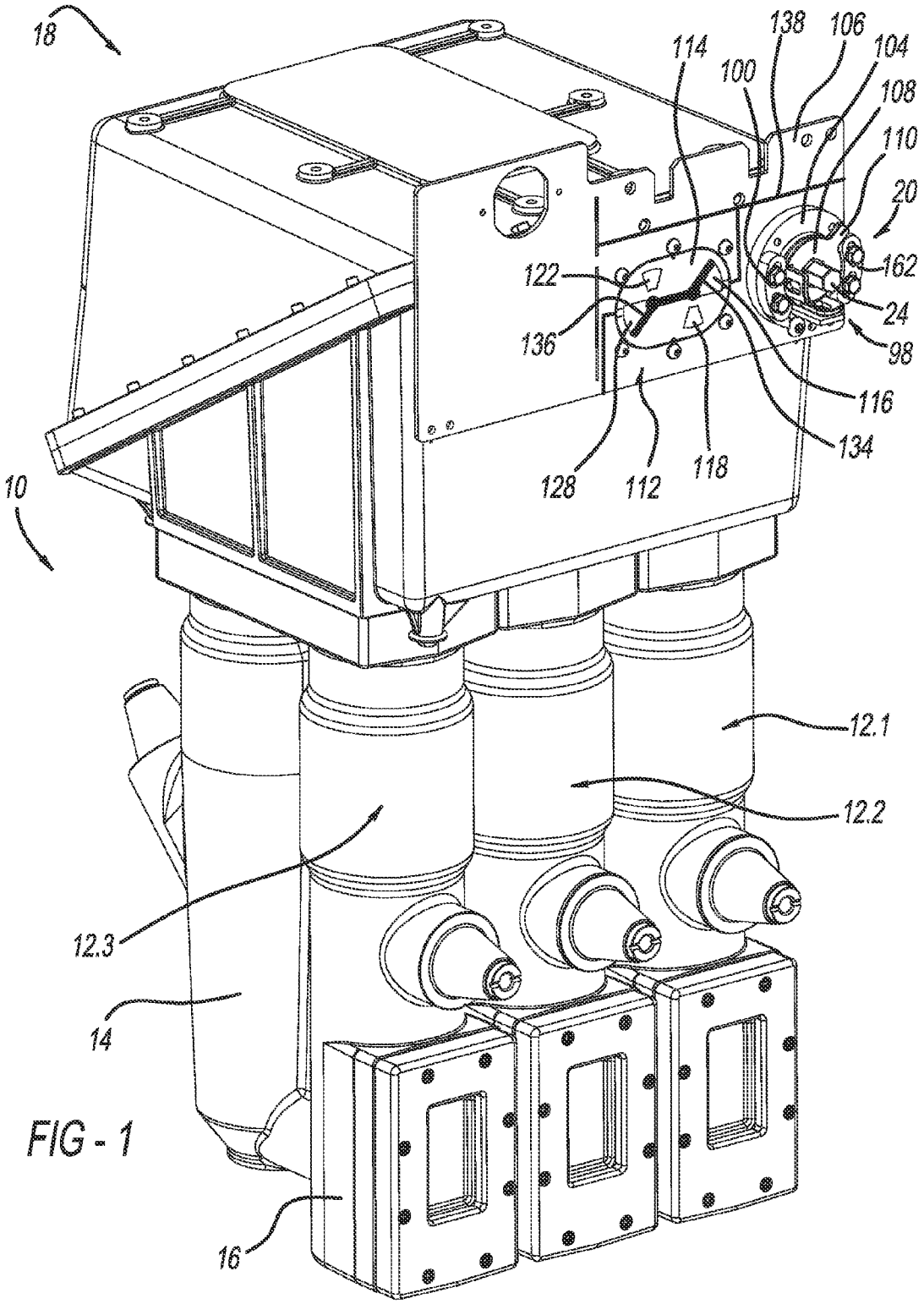
FIG. 1 is an isometric view of an interrupting device in accordance with the present disclosure.

An operating mechanism coupled to a switchgear unit moves the isolating disconnect contact and vacuum interrupter between their open and closed states. The operating mechanism may be manually or automatically actuatable to move the isolating disconnect from one state (i.e. opened) to another state (i.e., closed). The operating mechanism may further couple to an interrupter trip assembly to provide for opening of the contacts of the vacuum interrupter prior to the isolating disconnect making or breaking contact.

To simplify the external mechanical interface for the switchgear unit described above, a rotary handle or other operator drives a single input shaft for opening and closing both switches (i.e., the vacuum interrupter and the isolating disconnect). Roughly 90° rotation in one direction opens both switches, and about the same rotation in the opposite direction closes them. Each directional motion executes two functions. Rotating the handle in the closing direction, first operates the isolating disconnect at a speed dependent on the handle rotation, and then operates an independent high-speed closing of the vacuum interrupter at the end of the handle stroke. Likewise, rotating the handle in the opposite, opening direction initiates a reverse sequence such that a high-speed opening of the vacuum interrupter occurs, followed by an opening of the isolating disconnect at a speed dependent on the handle rotation.

For the vacuum interrupter, the switchgear drive mechanism uses a high-speed close, "trip-free" open spring-drive mechanism similar to that used in conventional drive mechanisms. A spring driven cam collapses a toggle linkage for closing the vacuum interrupt while simultaneously charging a release spring for the next opening operation of the vacuum interrupter. Opening of the vacuum interrupter may be achieved either manually with the switchgear drive mechanism or by an electrical trip solenoid when a fault is detected by an external relay. For the isolating disconnect, the switchgear drive unit uses an over-center linkage mechanism to open and close the isolating disconnect which provides a dwell for the vacuum interrupter to trip, thus ensuring that the isolating disconnect does not open under primary current.

The switchgear drive mechanism disclosed herein includes several features to address the design challenges discussed in the background above. A single-input drive shaft is used in combination with various linkages to ensure proper timing of the switches and avoids external interlock linkages. A cam-driven early trip linkage opens the vacuum interrupter at the start of drive shaft rotation to prevent the isolating disconnect from interrupting primary current. An over-center linkage in combination with specific lever geometry regulates the timing sequence between the isolating disconnect and the vacuum interrupter to ensure the isolating disconnect motion is minimal keeping the isolating disconnect is effectively in the closed position. In limited situations, contact welding may result when an extended arcing duration occurs during opening. In such situations, a safety interlock is provided with a safety catch to prevent opening the isolating disconnect if the vacuum interrupter contacts are welded during opening. If there is welding, the levers that drive the vacuum interrupter will move slightly but not sufficiently to allow the cam plate to continue its travel. The safety interlock also prevents the isolating disconnect from the closing if the vacuum interrupter has not been fully preset during the opening function. A spring assist mechanism is employed to balance the peak torque required during the opening and closing operations. Lastly, the input driveline includes externally mounted stops at both extents of input shaft rotation to prevent excessive operating force from being applied to the internal components of the switchgear unit. The drive mechanism further includes improved visual indicators for the status of opening and closing operations.

Example embodiments will now be described more fully with reference to the accompanying drawings. There is no intention to be limited by any principle presented in the preceding background or the following detailed description. Thus, while the switchgear drive mechanism disclosed herein is well-suited for three-phase gang-operated switches, one skilled in the art will recognize that the drive mechanism may be readily adapted to single-phase operation, where each phase require its own operating mechanism.

Figure 2:
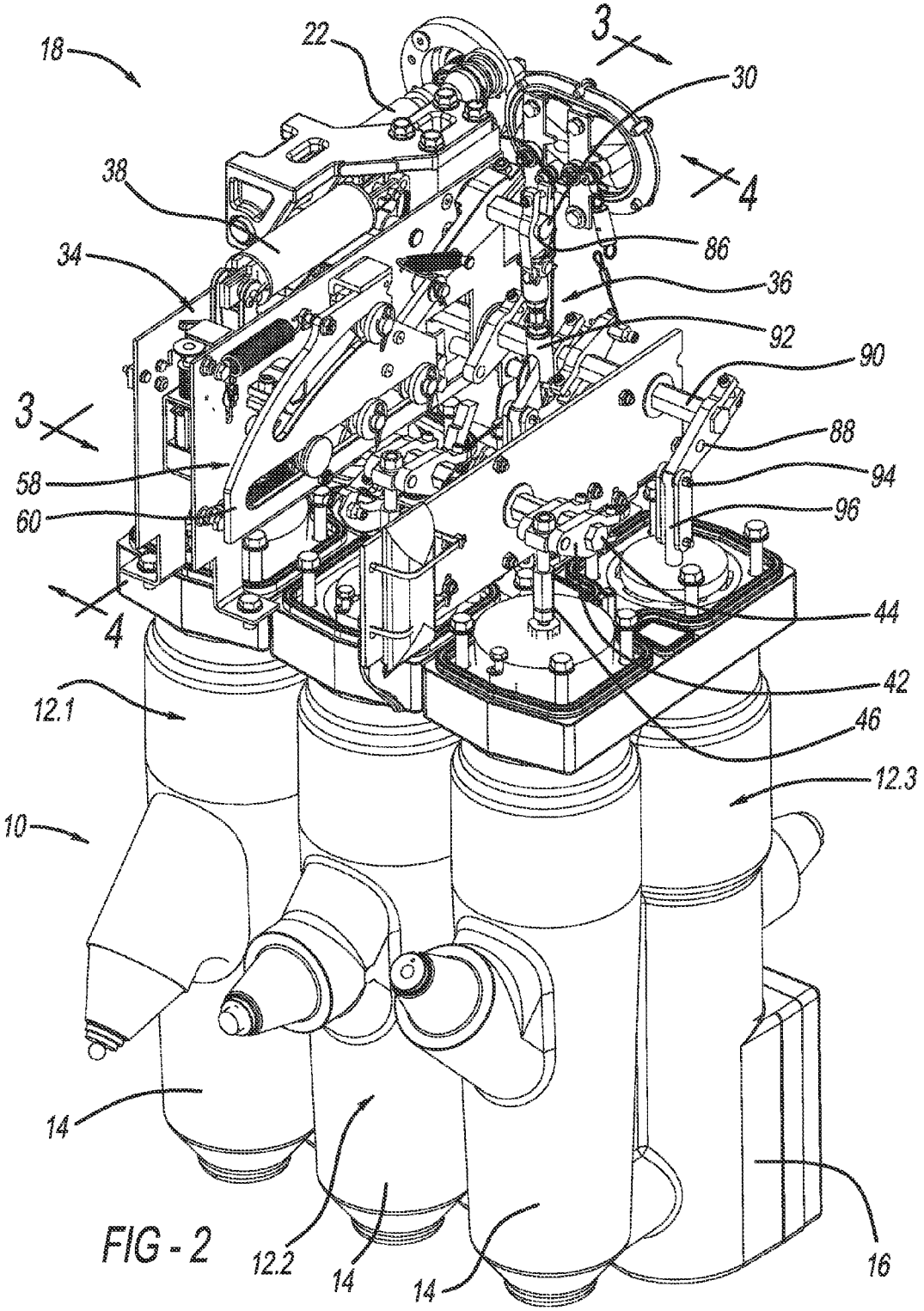
FIG. 2 is another isometric view of the interrupting device shown in FIG. 1 and further illustrating the operating mechanism.

FIGS. 1 and 2 illustrate a multi-phase, e.g., three phases interrupting device or switchgear unit 10 that incorporates for each phase a pole unit 12.1, 12.2, 12.3. Each pole unit 12 includes a pair of switched such as a vacuum interrupter 14 in series with a isolating disconnect 16. As illustrated in the figures, the interrupting device 10 is a three phase combination of integral vacuum interrupters for fault or load current making and breaking, in combination with series isolating disconnects to provide a visible close or open gap in the primary circuit. Circuit interrupting occurs via high-speed opening of the vacuum interrupter 14 followed by opening of the isolating disconnect 16. Circuit making occurs via high-speed closing of the vacuum interrupter 14 after closing of the isolating disconnect 16. Further details concerning the pole unit, its components and operation are described in U.S. Provisional Application No. 61/978,378, and U.S. Provisional Application No. 61/978,371, filed by Applicant, the disclosures of which are expressly incorporated by reference herein. Switchgear operating mechanism 18 functions to open, close and reclose the vacuum interrupter 14 and the isolating disconnect 16.

Figure 5:
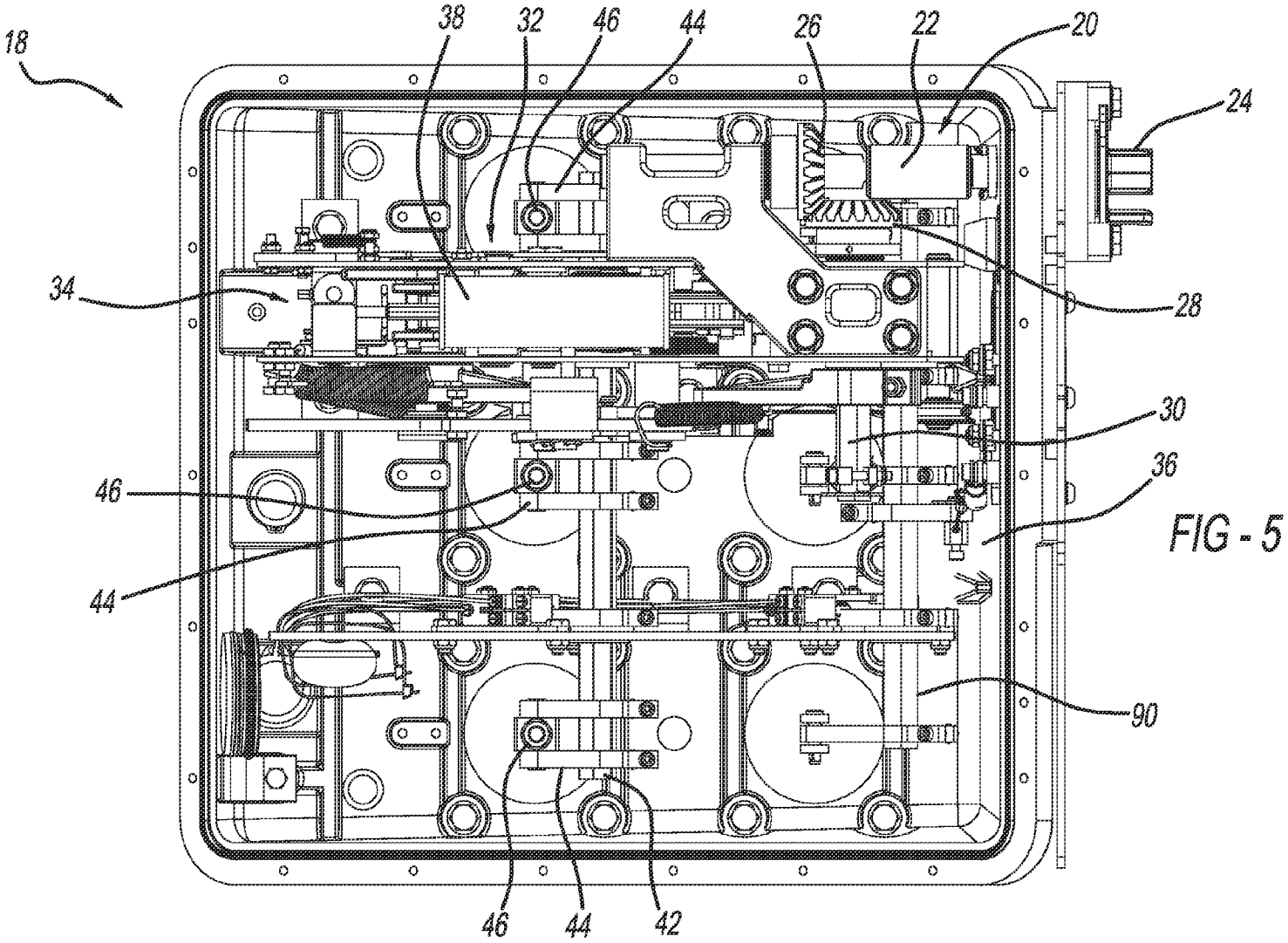
FIG. 5 is a plan view of the operating mechanism shown in FIG. 2.
Figure 7:
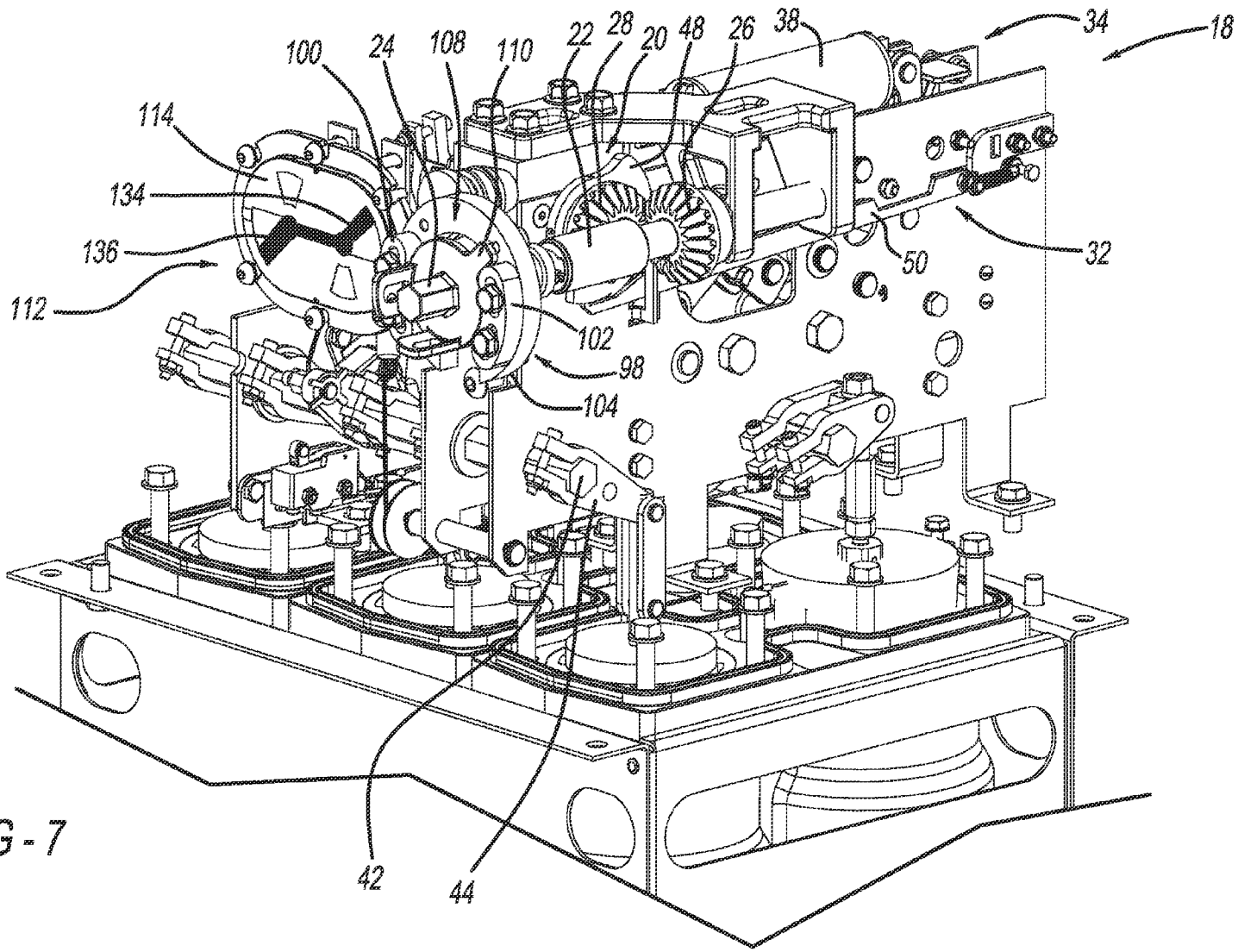
FIG. 7 is an upper front isometric view of the operating mechanism shown in FIG. 6.

As best seen in FIGS. 1, 5 and 7, the operating mechanism 18 includes a single input drivetrain 20 that includes input shaft 22 having a hex-head 24 configured to couple to a handle or motor operator (not shown) for driving the operating mechanism 18. The input drivetrain also includes a beveled gear 26 coupled to beveled gear 28 and drive shaft 30 extending therefrom. Rotation of input shaft 22 drives rotation of drive shaft 30 through beveled gears, 26, 28. As presently preferred, the drive ratio of input drivetrain 20 is 1:1 such that one rotation of hex-head 24 results in one rotation of drive shaft 30.

The drive shaft 30 drives a cam-driven early trip linkage 32 and spring-drive mechanism 34 for operating the vacuum interrupter 14, and an over-center linkage 36 for operating the isolating disconnect 16 during opening and closing operations. In response to clockwise rotation (i.e., opening) of the input shaft 22, the cam-driven early trip linkage 32 causes the vacuum interrupter 14 to open at high speed through the stored spring energy in the spring-drive mechanism 34. In response to counter-clockwise rotation (i.e. closing) of the input shaft 22, the drive shaft 30 operates the spring-drive mechanism 36 to close the vacuum interrupter 14 at high speed and resets the cam-drive early trip linkage 32.

Figure 6:
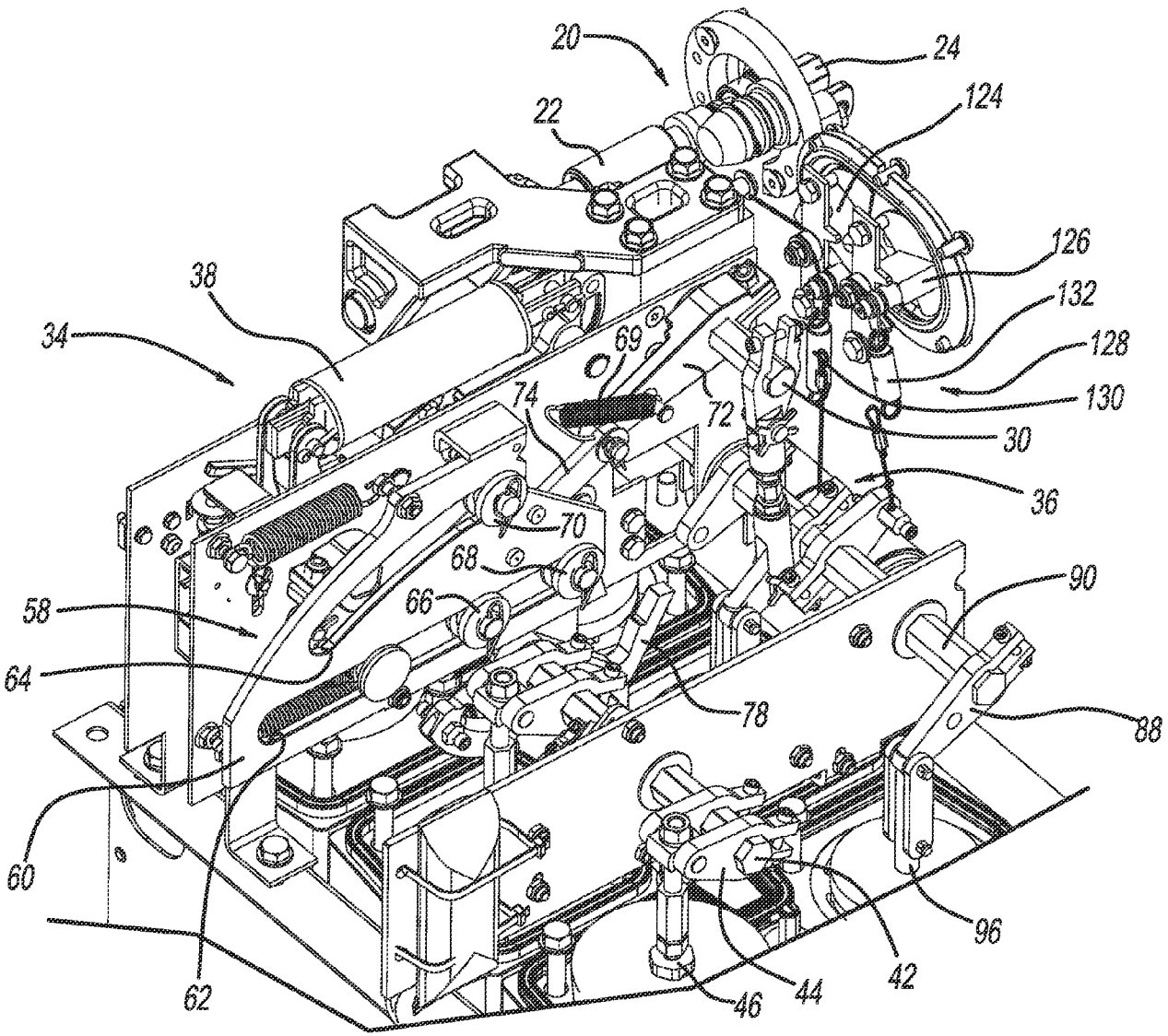
FIG. 6 is an upper rear isometric view of the operating mechanism similar to that shown in FIG. 2.

With reference now to FIGS. 2, 5-6, the spring-drive mechanism 34 includes a spring element 38 coupled to a conventional drive mechanism 40, which in turn rotates an output shaft 42. The spring-drive mechanism 34 communicates stored energy from the spring element 38 to rotationally drive the output shaft 42. Operating levers 44 are fixedly carried by the operating shaft 42 and arranged to operate the interrupters 14 through the dielectric operating rod 46.

Figure 3:
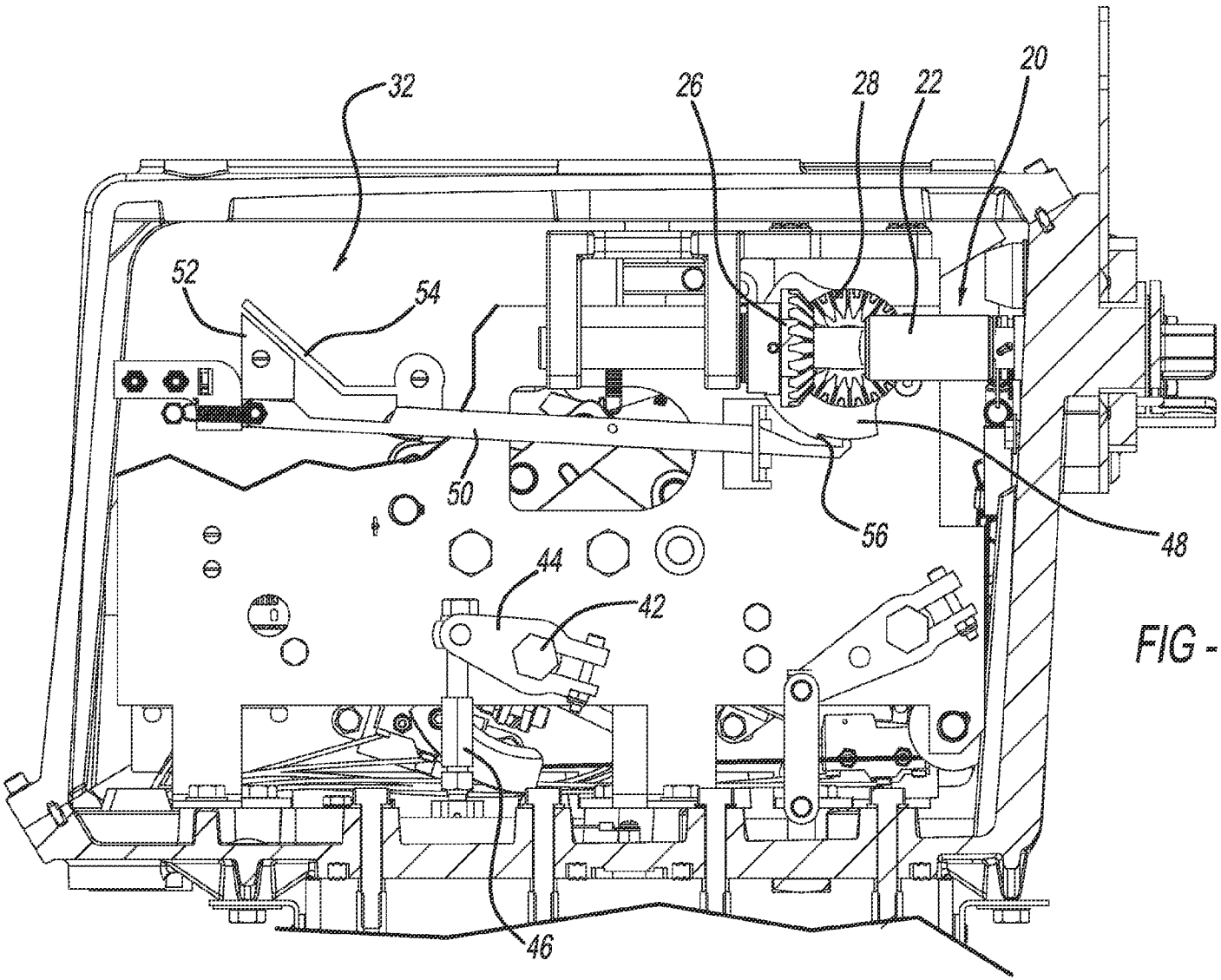
FIG. 3 is a cross-section taken along line 3-3 shown in FIG. 2.

The cam-driven early trip linkage 32 functions to trip the interrupters 14 open in either a manual mode or in response to a detected fault condition via a trip signal actuated by a solenoid. Referring now to FIG. 3, the cam-driven early trip linkage 32 is illustrated. The cam-driven early trip linkage 32 includes a cam disk 48 disposed on drive shaft 30, a trip link 50, a pry out lever 52 and an opening latch 54. The cam disk 48 is rotatably positionable on the drive shaft 30 and the trip link 50 is axially adjustable to trim the timing of the cam-driven early trip linkage 32. During initial rotation of the input shaft 22 (through about 20 degrees), the drive shaft 30 rotates the cam disk 48 through an angle to where a notch 56 in the cam disk 48 connects with a trip link 50 and pulls it to the right (as shown in FIG. 3). Translation of the trip link 50 to the right rotates the pry out lever 52, which releases the opening latch 54 to trigger the spring-drive mechanism 34 and open the vacuum interrupter 14. Further rotation of the cam disk 48 causes the trip link 50 to kick out, thereby releasing from the notch 56 in the cam disk 48 and allowing the trip link 50 and opening latch 54 to return to their initial positions.

Figure 4:
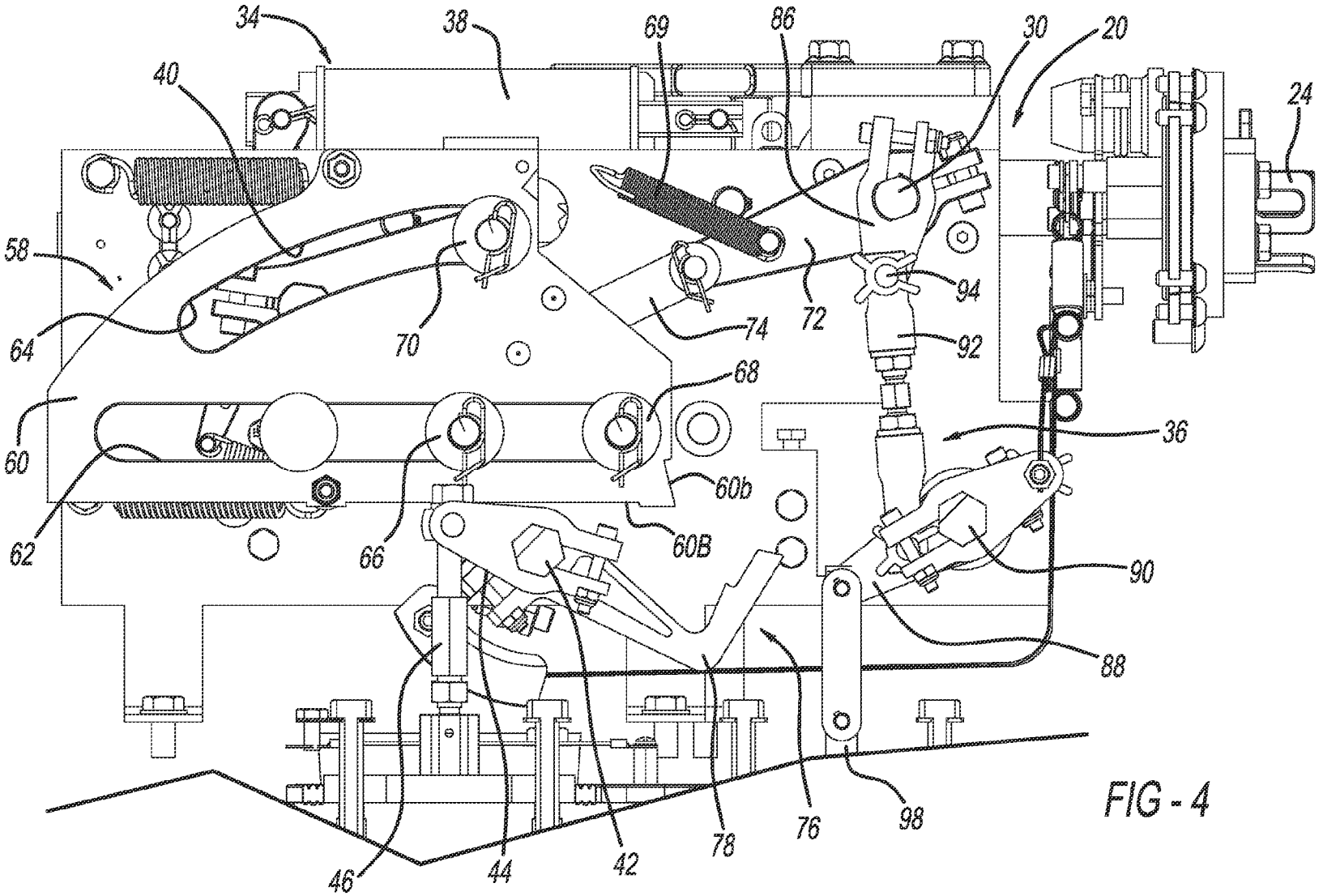
FIG. 4 is a cross-section taken along line 4-4 shown in FIG. 2.

In addition to operating the vacuum interrupter 14 through cam-driven early trip linkage 32 and spring-drive mechanism 34, rotation of drive shaft 30 via input shaft 22 operates a cam plate mechanism 58, which affects recharging of the spring drive mechanism 34. Referring to FIG. 4, cam plate mechanism 58 includes a cam plate 60 having a pair of lost motion slots 62, 64 supported by bearings 66, 68, 70. The cam plate mechanism 58 further includes a main drive lever 72 fixed for rotation with the drive shaft 30, a drive link 74 pivotally coupled at one end to the main drive lever 72 and at another end to a cam plate 60. The cam plate 60 cooperates with the spring-drive mechanism 34 through lost motion slot 64 and bearing 70 to recharge the spring element 38. For example, rotation of the drive shaft 30 in the counter-clockwise direction causes drive lever 72 and drive link 74 to pull the cam plate 70 forward. Once the interrupting device 10 is fully open, the input shaft 22 may be counter rotated such that the operating mechanism 18 closes the isolating disconnect 16 and the vacuum interrupters 14. In the process of counter-rotating the input shaft 22, the cam plate mechanism 58 operates to compress a closing spring 69, which stores enough energy to close the vacuum interrupters 14. In addition, the cam plate mechanism 58 simultaneously recharges the spring element 68 so that it is ready to respond to an opening event (either manually of from a fault).

A safety mechanism 76 cooperates with the cam plate mechanism 58 to provide an interlock, which block the cam plate 60 from translating forward (i.e., in toward the open position) when the vacuum interrupters 14 are closed. The safety mechanism 76 includes a lever arm 78 fixedly connected to the output shaft 42 follow the position on the vacuum interrupters 14. The lever arm 78 extends forward and upward with respect to cam plate 60. When the vacuum interrupters 14 are in a closed position, the safety mechanism 76 is rotated counter-clockwise from the position shown in FIG. 4 such that the lever arm 78 is positioned in front of the cam plate 60. In this position, the spacing between the leading edge 60L of the cam plate 60 and the lever arm 78 is such that input shaft 22 can operate the cam-driven early trip linkage 32 to affect an early trip high-speed opening operation. When the vacuum interrupters 14 are fully opened, the output shaft 42 has rotate clockwise to move the lever arm 78 away from the front of the cam plate 60 as shown in FIG. 4.

If an early trip does not occur and/or one or more of the vacuum interrupters 14 have welded, the leading edge 60L of the cam plate 60 will engage the lever arm 78 to block further movement of the operating mechanism 18 toward the fully open position. In particular, the drive lever 72 and drive shaft 30, which drive the cam plate 60 can no longer rotate to allow the isolating disconnects 16 to open. In this manner, timing of the operating mechanism 18 is controlled to ensure that the isolating disconnects 16 are not opened before the vacuum interrupters 14 are opened, thus preventing the isolating disconnects 16 from opening under primary current.

As noted above, when the vacuum interrupters 14 are fully opened, the lever arm 78 is clear of the cam plate 60 to allow for its intended travel so that the isolating disconnects 16 can be moved into the fully opened position. The safety mechanism 76 provides a secondary blocking function, which prevents the input shaft 22 from being counter-rotated before it has been fully rotated into the open position, thus preventing the isolating disconnects 16 from reclosing if the vacuum interrupters 14 have not been fully opened and reset. Counter-rotation of the input shaft 22 in the closed direction before it has been fully rotated to the open position causes the safety mechanism 76 to engage the cam plate 60. In particular, counter-rotation of the input shaft 22 rotates output shaft 42 so that the lever arm 78 engages the bottom edge 60B of the cam plate 60 preventing the vacuum interrupters 14 from reclosing. Continued counter-rotation of the input shaft 22 will cause the lever arm 78 to engage stop 80, thereby preventing further translation of the cam plate 60 and counter-rotation of the input shaft 22. Both blocking conditions prevent the counter-rotation of the input shaft 22 until after it has been rotated to the fully opened position.

Referring now to FIGS. 2, 4 and 6-7, an over-center linkage 36 is used to drive the isolating disconnects 16. The over-center linkage 36 includes a drive link 86 fixedly carried on drive shaft 30, a follower link 88 fixedly carried on output shaft 90 and connection link 92 having a first end 94 coupled to drive link 86 and a second end coupled to follower link 88. A dielectric rod 96 is coupled to the end of the follower link 88 such that the over center linkage 36 moves the isolating disconnects 16 between a closed position and an open position. The orientation of drive link 86 on drive shaft 30 is such that initial rotation of the drive shaft 30 moves the first end 94 past a center point defined by the longitudinal axis of the drive shaft 30. Due to the geometry of the over-center linkage 36, the initial rotation of drive shaft 30 through about 20° results in very little vertical translation of the connecting link 92, follower link 88 and dielectric rod 96. While the initial rotation of drive shaft 30 is sufficient to allow operation of the vacuum interrupt 14, the isolating disconnect 16 is kept fully engaged. The remaining degrees of continued rotation (approximately 70°) is sufficient to fully disengage the isolating disconnects 16.

With reference now to FIGS. 1 and 7, the operating mechanism 18 is equipped with a stop mechanism 98 associated with the input shaft 22. The positive stop mechanism 98 includes a stop block defined by a pair of position stops 100, 102 circumferentially located about the input shaft 22 and secured to a faceplate 104 on housing 106 of the operating mechanism 18. The position stops 100, 102 may be adjustably positioned about the input shaft 22 to define stop limits. A pawl 108 is rotatably coupled to the input shaft 22 and further includes a radially extending portion 110 formed thereon. In operation, pawl 108 is rotated with input shaft 22 to open and close the vacuum interrupter 14 and isolating disconnects 16. When these switches reach the fully open position, extension 110 engages position stop 100. Likewise, when these switches reach the fully closed position, extension 110 engages position step 102. The stop mechanism 98 provides a positive mechanical stop, which prevents excessive torque transmission on the internal components of the operating mechanism 18. In addition, the position stops 100, 102 in combination with the extension 110 provide an obvious indication of the travel limits necessary to operate the switchgear unit 10.

With reference now to FIGS. 1 and 6-7, the operating mechanism 18 also includes a visual indicator 112 providing the status of the switchgear unit 10. The visual indicator 112 includes a display 114 having a set of windows 116, 118 indicating the status of the vacuum interrupter 14, and a set of windows 120, 122 indicating the status of the isolating disconnect 16. A first display element 124 is operably associated with windows 116, 118, and a second display element 126 is operably associated with windows 120, 122 The visual indicator 116 also includes a linkage mechanism 128 having a first linkage 130 operably coupling the first display element 124 to output shaft 42 for rotating the first display element 124 in response to opening and closing of the vacuum interrupters 14. The linkage mechanism 128 includes a second linkage 132 operably coupling the second display element 126 to the output shaft 90 for rotating the second display element 126 in response to opening and closing of the isolating disconnects 16.

As best seen in FIG. 1, the first and second display elements 124, 126 have lines 134, 136 which are displayed in windows 116, 120 and may be rotated into and out of alignment with indicia 138 on the housing 106. When the lines 134, 136 are aligned with indicia 138, the interrupting device 10 is in a fully closed position. In this state, the first and second display elements 124, 126 provide red indicia in windows 118, 122 indicating that primary current is running through the switchgear unit 10. When the lines 134, 136 are misaligned with indicia 138, the interrupting device is in a fully opened position. In this state, the first and second display elements 124, 126 provide green indicia in windows 118, 122 indicating that primary current is interrupted by the switchgear unit 10.

As previously described, rotation of the input shaft 22 into the closed position operates the cam plate mechanism 58 to compress the closing spring 69 and recharge the spring element 68. The operating torque on input shaft 22 required to affect a closing operation is relatively high in light of the potential energy imparted into springs 68, 69. In contrast, the operating torque to open the vacuum interrupts is minimal in that the rotation of the operating handle in the open direction need only trip the opening latch 54. This imbalance in operating torque can be adjusted with the use of a pair of counterbalance springs 140, 142. As best seen in FIGS. 4-6, springs 140, 142 are secured between the cam plate 60 and a rigid frame element 144. Forward movement of the cam plate 60 in response to rotation of the input shaft 22 toward the open position extends the springs 140, 142. By storing potential energy in springs 140, 142, the operating torque necessary to rotate the input shaft is increased. Counter-rotation of the input shaft 22 toward the closed position, causes the cam plate 62 move in a rearward direction, which is assisted by the energy stored in springs 140, 142. In this regard, the counterbalance springs 140, 142 act directly on the cam plate 60 and their spring energy then made available to assist in the closing operation. As a consequence, the torque to open the switch has increased and torque to close the switch has decreased, so that the peak operating torque for opening and closing operations are nearly equal, resulting in a more consistent user interface.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A operating mechanism for a switch gear unit including a vacuum interrupter having an open state and a closed state coupled in series with a isolating disconnect having an open state and a closed state, the operating mechanism comprising:

an input drivetrain including a drive shaft operable to rotate in a first direction for opening the vacuum interrupter and the isolating disconnect and to counter rotate in a second direction for closing the vacuum interrupter and the isolating disconnect;

a trip linkage having a cam disk rotatably coupled to the drive shaft, an opening latch coupled to a spring-drive mechanism for opening the vacuum interrupter, and a linkage cooperating with the cam disk to trip the opening latch;

an over-center linkage system having a drive link rotatably coupled to the drive shaft, a connecting link having a first end pivotally connected to the drive link and second end pivotally connected to a follower link for opening the isolating disconnect, wherein initial rotation of the drive shaft in the first direction drives the trip linkage for opening the vacuum interrupter and moves the drive link though an over-center position without opening the isolating disconnect; and wherein continued rotation of the drive shaft in the first direction drives the over-center linkage system for opening the isolating disconnect after the vacuum interrupter is opened.

2. The operating mechanism of claim 1 wherein the spring-drive mechanism comprises a drive mechanism including an output shaft operably coupled to a spring mechanism and an operating lever rotatably coupled to the output shaft and operable to open the vacuum interrupter.

3. The operating mechanism of claim 2 wherein the spring mechanism comprises a spring element operably coupled between the trip linkage and the drive mechanism to bias the vacuum interrupter towards an open position such that tripping the opening latch releases the spring element for quickly driving the vacuum interrupter into the open position.

4. The operating mechanism of claim 1 further comprising a cam plate mechanism including:

a cam plate supported for linear motion;

a drive lever rotatably coupled to the drive shaft;

a drive link operably coupled between the cam plate and the drive lever for moving the cam plate in a forward direction in response to rotation of the input drive shaft and in a rearward direction in response to counter-rotation of the drive shaft;

wherein the cam plate mechanism controls the relative timing for opening and closing the vacuum interrupter and the isolating disconnect.

5. The operating mechanism of claim 4 further comprising:

an output shaft operably coupled to the spring-drive mechanism and an operating lever rotatably coupled to the output shaft and operable to open the vacuum interrupter; and a safety mechanism having a lever rotatably coupled to the output shaft and cooperating with the cam plate mechanism to block operation of the over-center linkage system when the cam plate moves in the forward direction and the vacuum interrupter is not fully open.

6. The operating mechanism of claim 5 wherein the lever cooperates with the cam plate mechanism to block the spring-drive mechanism closing of the vacuum interrupter when the cam plate moves in the rearward direction and the isolating disconnect has not been fully opened and reclosed.

7. The operating mechanism of claim 4 wherein the cam plate mechanism further comprises a counterbalance spring secured between the cam plate and a rigid frame element, wherein forward movement of the cam plate loads the spring and rearward movement of the cam plate unloads the spring for offsetting a torque differential between rotation and counter rotation of the drive shaft.

8. The operating mechanism of claim 4 wherein the cam plate mechanism is operably coupled to the spring-drive mechanism such that reward movement of the cam plate recharges a spring element associated with the spring-drive mechanism.

9. The operating mechanism of claim 1 further comprising a positive stop mechanism including:

a stop block concentrically located about the drive shaft and having a first stop associated with a fully opened position and a second stop associated with a fully closed position; and a pawl rotatably coupled to the drive shaft and operable to engage the first stop for preventing further rotation of the drive shaft, and to engage the second stop for preventing further counter rotation of the drive shaft.

10. The operating mechanism of claim 1 further comprising a visual indicator of the switch status including:

a display having a first window indicating a status of the vacuum interrupter and a second window indicating a status of the isolating disconnect;

a first display element operably associated with the display for moving a first indicia on the first display element with respect to the first window;

a first linkage operably coupling the first display element to the spring-drive mechanism for moving the first display element in response to opening and closing of the vacuum interrupters;

a second display element operably associated with the display for moving a second indicia on the second display element with respect to the second window;

a second linkage operably coupling the second display element to the over-center linkage for moving the second display element in response to opening and closing of the isolating disconnect.

11. A switchgear unit for interrupting a primary current, the switchgear unit comprising:

a pole unit having a vacuum interrupter including a first connecting rod operable to open and close a vacuum interrupt, and a isolating disconnect electrically coupled in series with the vacuum interrupter, the isolating disconnect having a second connecting rod operable to open and close a disconnect; and an operating mechanism operably coupled to the pole unit for opening and closing the vacuum interrupter and the isolating disconnect, the operating mechanism including:

an input drivetrain including a drive shaft operable to rotate in a first direction for opening the vacuum interrupter and the isolating disconnect and to counter rotate in a second direction for closing the vacuum interrupter and the isolating disconnect;

a trip linkage having a cam disk rotatably coupled to the drive shaft, an opening latch coupled to a spring-drive mechanism coupled to the first connecting rod for opening the vacuum interrupter, and a linkage cooperating with the cam disk to trip the opening latch;

an over-center linkage system having a drive link rotatably coupled to the drive shaft, a connecting link having a first end pivotally connected to the drive link and second end pivotally connected to a follower link, wherein the follower link is operably coupled to the second connecting rod for opening the isolating disconnect;

wherein initial rotation of the input drive shaft in the first direction drives the trip linkage for opening the vacuum interrupter and moves the drive link though an over-center position without opening the isolating disconnect; and wherein continued rotation of the drive shaft in the first direction drives the over-center linkage system for opening the isolating disconnect after the vacuum interrupter is opened.

12. The switchgear unit of claim 11 wherein the spring-drive mechanism comprises a drive mechanism including an output shaft operably coupled to a spring mechanism and an operating lever rotatably coupled to the output shaft and operable to open the vacuum interrupter.

13. The switchgear unit of claim 12 wherein the spring mechanism comprises a spring element operably coupled between the trip linkage and the drive mechanism to bias the vacuum interrupter towards an open position such that tripping the opening latch releases the spring element for quickly driving the vacuum interrupter into the open position.

14. The switchgear unit of claim 11 further comprising a cam plate mechanism including:

a cam plate supported for linear motion;

a drive lever rotatably coupled to the drive shaft;

a drive link operably coupled between the cam plate and the drive lever for moving the cam plate in a forward direction in response to rotation of the drive shaft and in a rearward direction in response to counter-rotation of the drive shaft;

wherein the cam plate mechanism controls the relative timing for opening and closing the vacuum interrupter and the isolating disconnect.

15. The switchgear unit of claim 14 further comprising:

an output shaft operably coupled to the spring-drive mechanism and an operating lever rotatably coupled to the output shaft and operable to open the vacuum interrupter; and a safety mechanism having a lever rotatably coupled to the output shaft and cooperating with the cam plate mechanism to block operation of the over-center linkage system when the cam plate moves in the forward direction and the vacuum interrupter is not fully open.

16. The switchgear unit of claim 15 wherein the lever cooperates with the cam plate mechanism to block the spring-drive mechanism closing of the vacuum interrupter when the cam plate moves in the rearward direction and the isolating disconnect has not been fully opened and reclosed.

17. The switchgear unit of claim 14 wherein the cam plate mechanism further comprises a counterbalance spring secured between the cam plate and a rigid frame element, wherein forward movement of the cam plate loads the spring and rearward movement of the cam plate unloads the spring for offsetting a torque differential between rotation and counter rotation of the drive shaft.

18. The switchgear unit of claim 14 wherein the cam plate mechanism is operably coupled to the spring-drive mechanism such that reward movement of the cam plate recharges a spring element associated with the spring-drive mechanism.

19. The switchgear unit of claim 11 further comprising a positive stop mechanism including:

a stop block concentrically located about the drive shaft and having a first stop associated with a fully opened position and a second stop associated with a fully closed position; and a pawl rotatably coupled to the drive shaft and operable to engage the first stop for preventing further rotation of the drive shaft, and to engage the second stop for preventing further counter rotation of the drive shaft.

20. The switchgear unit of claim 11 further comprising a visual indicator including:

a display having a first window indicating a status of the vacuum interrupter and a second window indicating a status of the isolating disconnect;

a first display element operably associated with the display for moving a first indicia on the first display element with respect to the first window;

a first linkage operably coupling the first display element to the spring-drive mechanism for moving the first display element in response to opening and closing of the vacuum interrupters;

a second display element operably associated with the display for moving a second indicia on the second display element with respect to the second window;

a second linkage operably coupling the second display element to the over-center linkage for moving the second display element in response to opening and closing of the isolating disconnect.

* * * * *